US005090147A

United States Patent [19]

Pastor

[11] Patent Number: 5,090,147

[45] Date of Patent: Feb. 25, 1992

[54] SELF-ENGAGING SAFETY

[76] Inventor: Walter Pastor, 1100 NE. 182nd St., No. Miami Beach, Fla. 33162

[21] Appl. No.: 658,515

[22] Filed: Feb. 21, 1991

[51] Int. Cl.[5] ..... F41A 17/28

[52] U.S. Cl. ..... 42/70.05; 89/148

[58] Field of Search ..... 42/70.01, 70.04, 70.05; 89/148, 150

[56] References Cited

U.S. PATENT DOCUMENTS

| | | | |
|---|---|---|---|
| 747,585 | 12/1903 | Browning | 89/148 |
| 1,070,582 | 8/1913 | Browning | 89/148 |
| 1,082,969 | 12/1913 | Nelson | 89/148 |
| 1,141,285 | 6/1915 | Swartz | 89/148 |
| 1,176,254 | 3/1916 | Smith | 89/148 |
| 1,206,892 | 12/1916 | Nelson | 89/148 |
| 1,410,270 | 3/1922 | Pedersen | 89/148 |
| 1,812,905 | 7/1931 | Stuyvesant | 89/148 |
| 2,115,041 | 4/1938 | Obregon | 89/148 |

*Primary Examiner*—Michael J. Carone
*Attorney, Agent, or Firm*—Malin, Haley, McHale, DiMaggio & Crosby

[57] ABSTRACT

A self-engaging safety is disclosed which works in addition to the standard grip safety having a forward edge slot and thumb safety of an automatic handgun having a frame, slide, mainspring housing, hammer and sear. The self-engaging safety has an elongated pin with an upper and lower end and a cross pin attached to the pin near its lower end at a right angle. The safety allows the grip safety and thumb safety to be deactivated only in a specific sequence. That sequence is that first the pistol handgrip must be gripped thereby deactivating the grip safety whereafter the thumb safety may be released allowing the gun to fire when the trigger is pulled. The self-engaging safety prevents the thumb safety from being deactivated prior to the grip safety being depressed.

17 Claims, 3 Drawing Sheets

SELF-ENGAGING SAFETY

BACKGROUND OF THE INVENTION

1. Field of the Invention

The instant invention relates to a self-engaging tertiary safety for guns of the Colt Model 1911 Auto variety or similar design.

2. Description of Related Art

The Colt Model 1911 Auto is a well known handgun. The basic design was introduced by Colt in 1911 and adopted by Army Ordinance. The gun now comes in a variety of chamberings incorporating the basic design in a variety of frame size ranges. All varieties of the basic design operate in essentially the same way.

All past and present models of the gun have a variety of safety systems. First, a manual safety is located on the left rear side of the frame just below the slide. This manual safety is sometimes called the thumb lock safety and is often called the thumb safety. When the hammer is fully cocked and the thumb lock safety is applied, the upper part of the thumb lock safety engages a thumb safety notch in the slide. Simultaneously, an internal sear blocking stud on the thumb safety moves between the sear and the hammer body to prevent the hammer from moving forward when the trigger is squeezed. The thumb safety can be applied only when the slide is fully forward and the hammer is fully cocked.

The grip safety is an additional safety system that permits firing the handgun only when the grip safety is fully depressed by the web of the hand. The grip safety is located on the upper rear part of the receiver grip. The grip safety pivots around the thumb lock pivot shaft and makes contact at its lower end with a main spring housing and a sear spring. This configuration allows the grip safety to move relative to the main spring housing when the grip safety is depressed by the web of the hand when the pistol grip is grasped. The sear spring pushes the grip safety back to its original position thereby activating the grip safety when the web of the hand is removed from contact with the grip safety. An integral tang of the grip safety, sometimes called the stop tip, which is located inside the pistol frame, contacts the rear of the trigger to prevent its rearward movement. When the pistol grip is grasped, thereby depressing the grip safety, the grip safety stop tip is rotated out of contact with the rear of the trigger to allow the trigger to move.

The thumb and grip safeties may of course be inactivated by deliberate action. Unfortunately, however, these safeties may be inactivated inadvertently. In addition, the thumb and grip safetys may be inactivated in any order, that is, the thumb safety may be inactivated and then the grip safety inactivated by grasping the handle, or the grip safety may first be inactivated by grasping the handle and then the thumb safety deactivated. Because the safetys may be deactivated in any order, a problem is presented, particularly when the handgun is removed from a holster or similar confinement. In removing the handgun from the holster, the thumb safety may be inadvertently moved from an original activated position to a deactivated position by physical contact with objects near the holster or by friction with the holster as the handgun is pulled from the holster. Thereafter, as the handle of the gun is gripped, the grip safety is deactivated. Because both safeties are now deactivated, contact with the trigger may fire the pistol despite the user's belief that the thumb safety is still engaged. The proceeding sequence of events may occur without the gun user being aware that the thumb safety has been deactivated. This is particularly dangerous where the gun user is unaware that the thumb safety has been deactivated and is acting in the mistaken belief that the thumb safety is still activated. This problem of the thumb safety being accidentally deactivated is a problem in want of a solution.

SUMMARY OF THE INVENTION

A self-engaging tertiary safety is provided which allows the grip safety and thumb safety to be deactivated only in a specific sequence. That sequence is that first the pistol handgrip must be gripped thereby deactivating the grip safety whereafter the thumb safety may be released allowing the gun to fire when the trigger is pulled. The instant invention prevents the thumb safety from being deactivated prior to the grip safety being depressed. Because the thumb safety can be deactivated only after the grip safety is deactivated which occurs only when the handgun is grasped prepatory to firing, the thumb safety cannot be accidentally deactivated. This reduces the possibility, that the pistol may be accidentally discharged.

The instant invention may be retrofitted to an existing Model 1911 Colt semi-automatic pistol or equivalent with a minimum of modification. The instant invention does not alter the operation of the handgun in any respect other than to determine the sequence of deactivating the safeties prior to firing.

It is therefore an object of the instant invention to provide a self-engaging tertiary safety which allows the release of the grip safety and the thumb safety in a specific order in order to improve safety of the handgun.

It is another object of the instant invention to provide such a tertiary safety which requires relatively minor modification to the handgun.

It is yet another object of the instant invention to provide a tertiary safety which does not alter the operation of the handgun in any way except to determine the sequence of deactivating the safeties prior to firing.

These and other objects of the instant invention will become apparent from the following detailed description of the invention where like elements are referred to by like numerals.

DETAILED DESCRIPTION OF THE INVENTION

Figure 1:
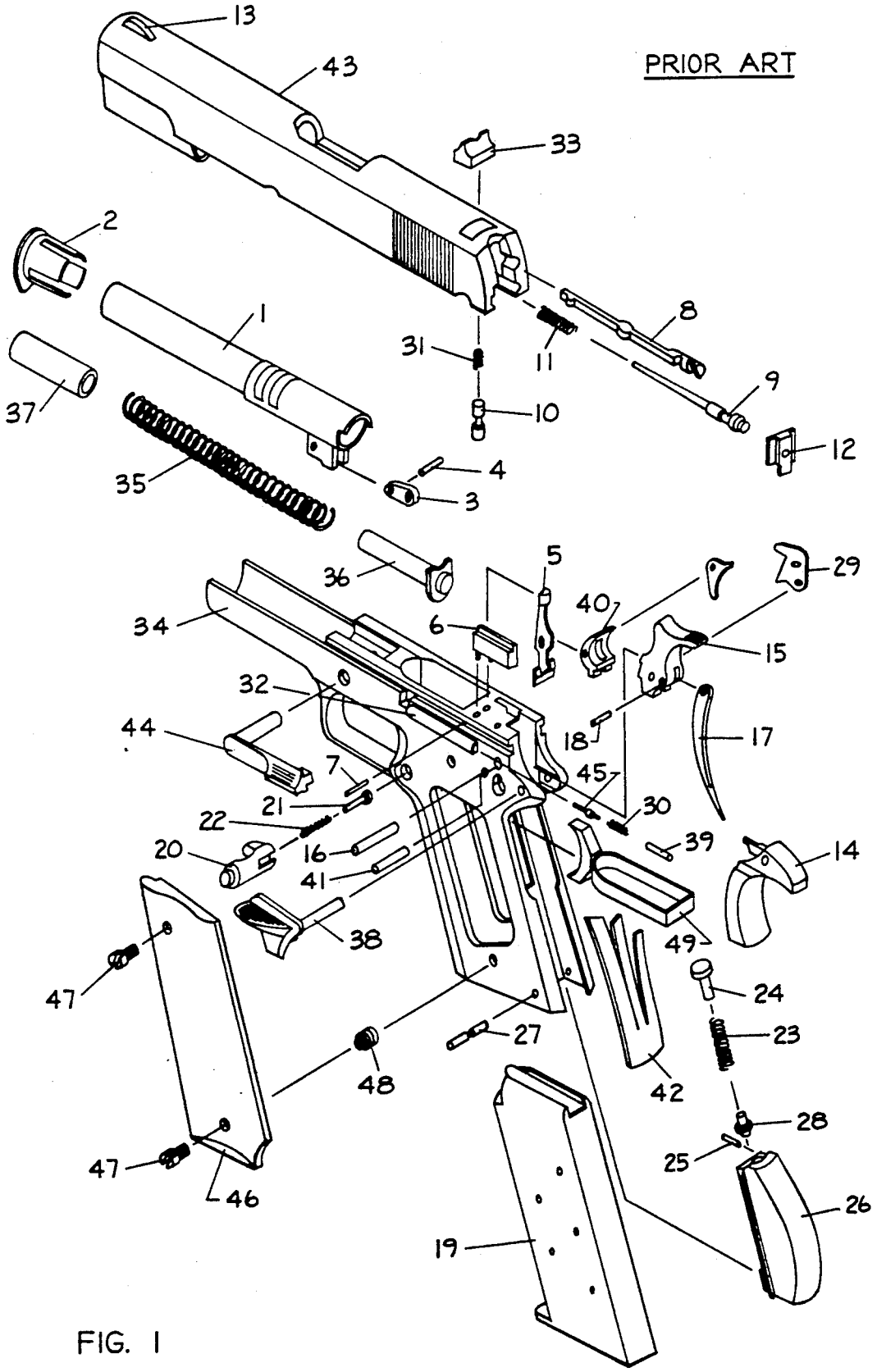
FIG. 1 is an exploded view of the handgun.

The basic Colt Model 1911 handgun is shown in exploded view in FIG. 1. A catalog of the parts, which are well known in the art, is given below in order to aid in locating and understanding the instant invention.

| | |
|---|---|
| 1. Barrel | 26. Main Spring Housing |
| 2. Barrel Bushing | 27. Main Spring Housing Pin |
| 3. Barrel Link | 28. Main Spring Housing Pin Retainer |
| 4. Barrel Link Pin | 29. Plunger Lever |
| 5. Disconnector | 30. Plunger Spring |
| 6. Ejector | 31. Plunger Spring |
| 7. Ejector Pin | 32. Plunger Tube |
| 8. Extractor | 33. Rear Sight |
| 9. Firing Pin | 34. Frame |
| 10. Firing Pin Plunger | 35. Recoil Spring |
| 11. Firing Pin Spring | 36. Recoil Spring Guide |
| 12. Firing Pin Stop | 37. Recoil Spring Plug |
| 13. Front Sight | 38. Thumb Safety |
| 14. Grip Safety | 39. Safety Lock Plunger |
| 15. Hammer | 40. Sear |
| 16. Hammer Pin | 41. Sear Pin |
| 17. Hammer Strut | 42. Sear Spring |
| 18. Hammer Strut Pin | 43. Slide |
| 19. Magazine Assembly | 44. Slide Stop |
| 20. Magazine Catch | 45. Slide Stop Plunger |
| 21. Magazine Catch Lock | 46. Stock Set |
| 22. Magazine Catch Spring | 47. Stock Screw |
| 23. Main Spring | 48. Stock Screw Bushing |
| 24. Main Spring Cap | 49. Trigger Assembly |
| 25. Main Spring Cap Pin | |

An elongated narrow pin 54 having a cross-pin 56 attached near one end is provided. Pin 54 is about 2½ inches long and about 1/16th of an inch in diameter. Cross-pin 56 has a similar diameter and is integrally attached to pin 54 at a right angle. Spring stop 58 is attached to pin 54 between cross-pin 56 and the end of pin 54 farthest from cross-pin 56. Spring stop 58 protrudes outward from pin 54. Pin 54, cross-pin 56 and spring stop 58 are preferably made in an integral unit of high grade steel.

A hole 66 larger in diameter than pin 54 is drilled in the bottom of grip safety 14 providing access to preexisting slot 65 of grip safety 14 from the bottom of grip safety 14. Slot 65 extends along the forwardmost edge of grip safety 1 from just above the lowermost edge of grip safety 14 to the top of the forwardmost edge of grip safety 14. Hole 66 is elongated in cross section with its elongated axis directed perpendicular to the barrel 1 of the gun. The elongated axis is sized to allow pin 54 and spring stop 58 to pass through hole 66 when spring stop 58 is aligned with the elongated axis. However, hole 66 is sized to prevent spring stop 58 from passing out of hole 66 when pin 54 is rotated about its longitudinal axis by 90 degrees from its orientation which allows spring stop 58 to pass through hole 66.

A loop 62 which is preferrably a band of high grade steel is securely attached to the outside of the existing slot 65 in grip safety 14. Loop 62 constrains pin 54 in its movement within slot 65 as pin 54 rotates around cross-pin 56 as will be described hereafter. Loop 62 is preferably attached to grip safety 14 by means of soldering. A spring 60 is placed within slot 65 below loop 62 between loop 62 and hole 66 with the axis of the spring 60 directed along slot 65. Loop 62 provides an enclosure in slot 65 that is smaller than the diameter of spring 60. This enclosure helps to locate spring 60 within slot 65 below loop 62. Spring 60 places a bias on pin 54 to properly position cross-pin 56 against the main spring housing 26 and to position pin 54 in slot 65 according to the relative positions of cross-pin 56 on mainsring housing 26 and grip safety 14 as will be descirbed.

A hole 64, having a diameter smaller than the length of cross-pin 56, is drilled into main spring housing 26 from the top next to ridge 67 which extends across the upper surface of mainspring housing 26 in a direction perpendicular to the axis of barrel 1.

Pin 54 is inserted through hole 66 in grip safety 14 by rotating pin 54 so that spring stop 58 is aligned with the elongated portion of hole 66. Thereafter pin 54 is pushed through hole 66 until spring stop 58 is presented in slot 65. Thereafter, pin 54 is rotated ninety degrees so that spring stop 58 is prevented from passing out of hole 6 by abutting contact with the bottom of slot 65. In this configuration, pin 54 is restrained from moving downward out of slot 65 through hole 66 by the contact of spring stop 58 with the bottom of slot 65. As pin 54 is inserted through hole 66 into slot 65, the upper end of pin 54 passes through spring 60, which has previously been located in slot 65 below loop 62, until spring stop 58 comes in contact with spring 60. The configuration of loop 62, spring 60 and spring stop 58 biases pin 54 toward main spring housing 26. When pin 54 is positioned within slot 65 as described above, the upper portion of pin 54 extends above the upper end of slot 65.

The bottom portion of pin 54 is inserted into hole 64 in main spring housing 26 until cross pin 56 comes in contact with the upper portion of main spring housing 26 at ridge 67. Cross pin 56 holds pin 54 in position within hole 64 by contact with the upper portion of main spring housing! 26. Ridge 67, along the top of main spring housing 26, constrains cross pin 56 from rotating about pin 54's longitudinal axis thereby holding pin 54 in a precise orientation with respect to main spring housing 26. However, pin 54 is allowed to pivot around the longitudinal axis of cross-pin 56. Because pin 54 may rotate around cross-pin 56, the upper end of pin 54 may move back and forth in slot 65 constrained by spring 60 and loop 62 while the bottom end of pin 54 moves back and forth in hole 64.

Figure 2:
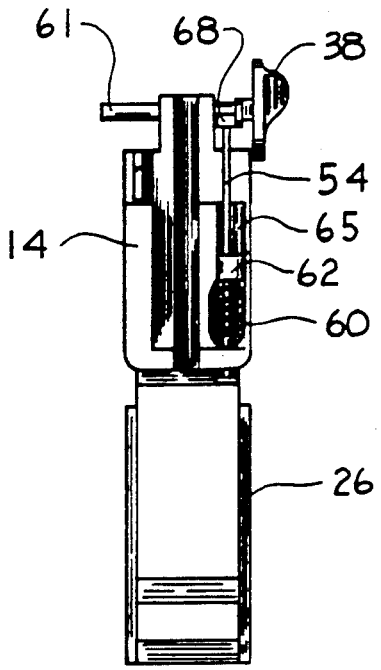
FIG. 2 is a front elevational view of the thumb safety, grip safety and main spring housing showing the invention.
Figure 3:
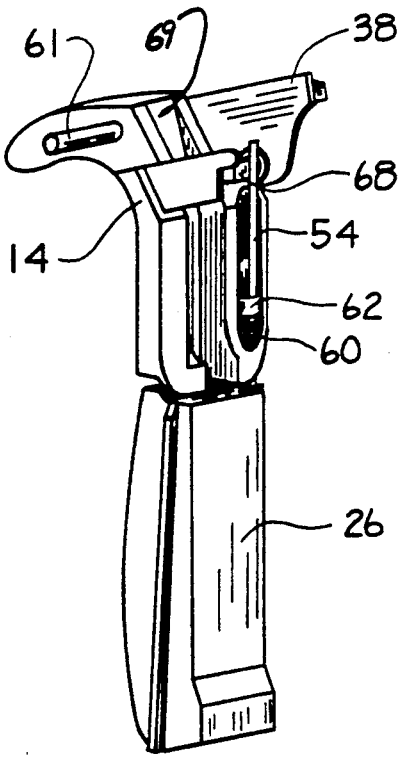
FIG. 3 is a perspective view of the grip safety of FIG. 2.
Figure 4:
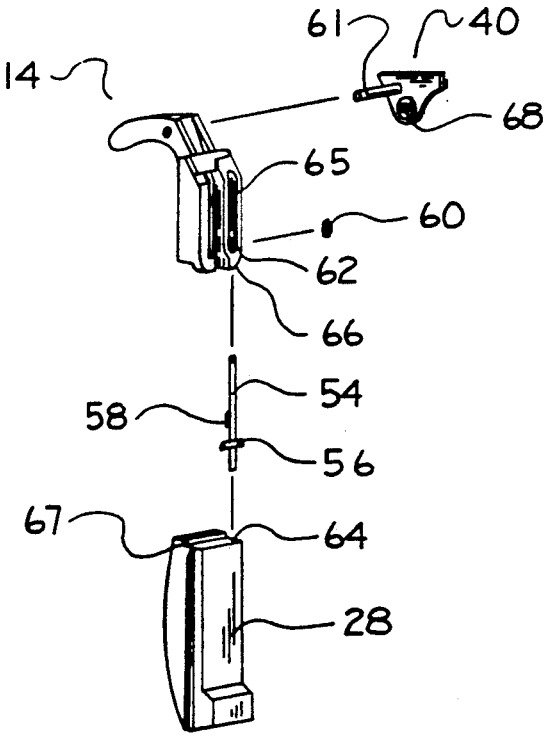
FIG. 4 is an exploded view of the invention, the thumb safety, the grip safety and the main spring housing.

As stated, when pin 54 is in place within slot 65 and positioned in hole 64, the upper portion of pin 54 extends entirely through and above slot 65 to the general area of sear blocking stud 68 attached to thumb safety 38 as shown in FIGS. 2 through 3. Sear blocking stud 68 is a cam extending away from thumb safety 38 into the frame 34 of the handgun. When thumb safety 38 is activated, sear blocking stud 68 prevents the sear 40 from rotating in response to pressure on the trigger 49 thereby releasing the cocked hammer 15.

Figure 5:
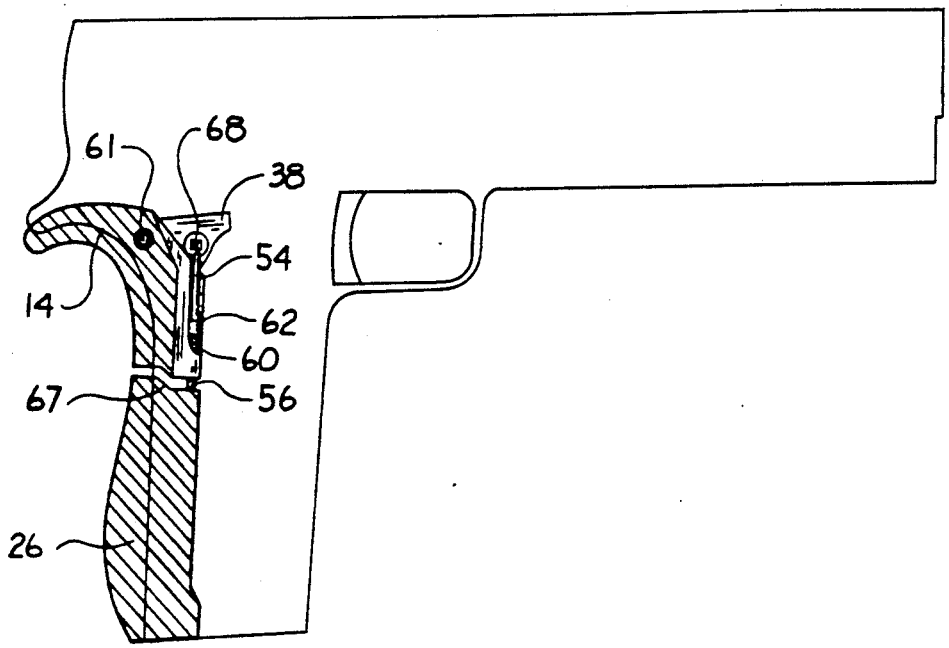
FIG. 5 is an side cut-away view of the invention in position to prevent the thumb safety from being deactivated.

When the handgun is assembled and the grip safety is not depressed by contact with the web of the hand, pin 54 extends upward from its pivot point around cross-pin 56 on main spring housing 28 through slot 65. Now, when hammer 15 is placed in the cocked position, thumb safety 38 may be rotated into the safety position, causing the sear blocking stud 58 to immobolize sear 40 to prevent hammer 15 from falling on firing pin 9. This is done by rotating thumb safety 38 around pivot shaft 61 thereby raising sear blocking stud 68 which is integrally attached to thumb safety 38. With the instant invention, when sear blocking stud 68 is raised by pivoting thumb safety 38 around pivot shaft 61 the upper end of pin 54 moves under contact with the body of grip safety 14 to a position below sear blocking stud 68 as shown in FIGS. 2 and 5. In this position, pin 54 prevents thumb safety 38 from rotating downward around pivot shaft 61 to the deactivated position by physical contact of the upper end of pin 54 with sear blocking stud 68. Because sear blocking stud 68 is prevented from moving downward out of contact with sear 40, hammer 15 is prevented from falling and discharging the handgun.

Figure 6:
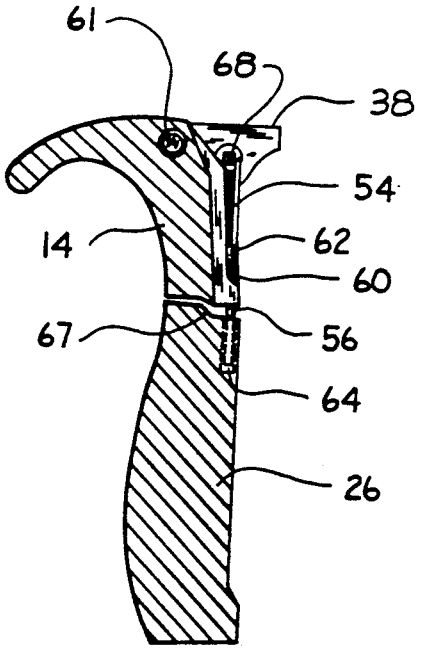
FIG. 6 is a side cut-away viw of the invention in its forward position and the thumb safety deactivated.

In order to move pin 54 so that sear blocking stud 68 may be rotated downward as thumb safety 38 is deactivated, the grip safety 14 must be grasped. This causes grip safety 14 and the attached grip safety stop tip 69 to rotate upward around pivot shaft 61 allowing the trigger assembly 49 to be depressed. This rotation of grip safety 14 changes the orientation of slot 65 and consequently redirects pin 54 so that pin 54 is moved forward of sear blocking stud 68 as shown in FIGS. 3 and 6. When pin 54 is moved free of sear blocking stud 68, thumb safety 38 may be rotated downward around pivot shaft 61 thereby deactivating thumb safety 38, allowing the handgun to be fired when the trigger 49 is depressed.

Sear Spring 42 puts a constant rearward pressure on pin 54 through its bias against grip safety 14. This bias against grip safety 14 is transferred to pin 54 through contact with grip safety 14 so that as soon as sear blocking stud 68 is raised by rotation of thumb safety 38 around pivot shaft 61, the upper part of pin 54 is automatically forced rearward to a position beneath sear blocking stud 68. There, the upper end of pin 54 engages sear blocking stud 68 (FIGS. 3 and 5) preventing thumb safety 38 from rotating downward before grip safety 14 has been grasped. In this way, pin 54 provides a self-actuating stop against the accidental or deliberate release of thumb safety 38 before the handgun has been properly grasped and the grip safety 14 released.

The instant invention has been described in connection with a specific embodiment. However, this description is given by means of example and not for purposes of limitation. It is understood that changes and modifications may be made to the description contained herein and still be within the scope of the invention. Further, obvious changes and modifications will occur to those skilled in the art.

What I claim is:

1. A self-engaging tertiary safety for a handgun having a hammer releasable by a sear, said handgun also having a grip, thumb safety and a grip safety, said thumb safety having a cam attached thereto, said cam immobilizing a sear when said thumb safety is placed in an active position thereby preventing the hammer of said handgun from falling, said grip safety having a slot extending along the forwardmost edge of said grip safety, said handgun also having a grip member located below said grip safety in said grip of said handgun, said tertiary safety comprising:

a) an elongated pin having an upper and a lower end, said pin extending from a grip member aperture, said grip member aperture extending downward into said grip member from the upper surface of said grip member, said pin extending upward from said grip member aperture through a grip safety aperture in the lowermost edge of said grip safety thereby connecting said lowermost edge with said slot, said pin extending through said slot to a point above said grip safety; and, b) means for moving said upper end of said pin from a position below said cam to a position forward of said cam in response to forward movement of said grip safety whereby said upper end of said pin prevents said cam from moving to a position to allow said sear to allow said hammer to fall, said cam prevented from moving downward by physical contact between said upper end of said pin and said cam when said grip safety is in a position below said cam and whereby said upper end of said pin is moved forward of said cam in response to forward movement of said grip safety, thereby permitting said cam to move to a position to allow said sear to allow said hammer to fall, said cam moving to a position to allow said sear to allow said hammer to fall in response to downward movement of said thumb safety.

2. The tertiary safety of claim 1 wherein said grip member is a mainspring housing.

3. The tertiary safety of claim 1 wherein said means for moving said upper end of said pin comprises:

a) means for pivoting said pin around the upper edge of said grip member aperture; and, b) means for positioning said pin within said slot so that movement of said grip safety contacts said pin and rotates said pin around said means for pivoting said pin thereby moving said upper end of said pin from a position below said cam to a position forward of said cam in response to forward movement of said grip safety.

4. The tertiary safety of claim 3 wherein said means for pivoting said pin comprises a cross pin attached to said pin, said cross pin spanning said grip member aperture.

5. The tertiary safety of claim 4 wherein said cross pin is attached to said pin at a right angle.

6. The tertiary safety of claim 4 wherein said grip member includes a means for orienting said cross pin with respect to said grip member.

7. The tertiary safety of claim 6 wherein said means for orienting said cross pin comprises a ridge extending across said grip member, said ridge contacting said cross pin thereby preventing said cross pin from rotating about the elongated axis of said pin.

8. The tertiary safety of claim 3 wherein said means for positioning said pin within said slot includes:

a) a spring, located within said slot, having its direction of compression colineal with said slot, said spring encircling said pin, said spring having a lower edge located closest to said grip safety aperture;

b) means for positioning said spring within said slot;

c) means, attached to said pin, for transferring the bias of said spring to said pin when said spring is compressed so that said pin is biased toward said grip member aperture thereby biasing said means for pivoting said pin into contact with said upper edge of said grip member.

9. The tertiary safety of claim 8 wherein said means for transferring the bias of said spring comprises a protrusion on said pin contacting said lower edge of said spring within said slot.

10. The tertiary safety of claim 8 wherein said means for positioning said spring comprises a loop attached to said grip safety across said slot, said loop providing a constriction in said slot narrower than said spring whereby said spring and said pin is constrained within said slot.

11. A self-engaging tertiary safety for a handgun having a hammer releasable by a sear, said handgun also having a grip, thumb safety and a grip safety, said thumb safety having a cam attached thereto, said cam immobilizing a sear when said thumb safety is placed in an active position thereby preventing the hammer of said handgun from falling, said grip safety having a slot extending along the forwardmost edge of said grip safety, said handgun also having a grip member located below said grip safety in said grip of said handgun, said tertiary safety comprising:

a) an elongated pin having an upper and a lower end, said pin extending from a grip member aperture, said grip member aperture extending downward into said grip member from the upper surface of said grip member, said pin extending upward from said grip member aperture through a grip safety aperture in the lowermost edge of said grip safety thereby connecting said lowermost edge with said slot, said pin extending through said slot to a point above said grip safety; and, b) means for moving said upper end of said pin from a position below said cam to a position forward of said cam in response to forward movement of said grip safety whereby said upper end of said pin prevents said cam from moving to a position to allow said sear to allow said hammer to fall, said cam prevented from moving downward by physical contact between said upper end of said pin and said cam when said grip safety is in a position below said cam and whereby said upper end of said pin is moved forward of said cam in response to forward movement of said grip safety, thereby permitting said cam to move to a position to allow said sear to allow said hammer to fall, said cam moving to a position to allow said sear to allow said hammer to fall in response to downward movement of said thumb safety, said means for moving said upper end of said pin comprising:

i) means for pivoting said pin around the upper edge of said grip member aperture comprising a cross pin attached to said pin, said cross pin spanning said grip member aperture;

ii) means for positioning said pin within said slot so that movement of said grip safety contacts said pin and rotates said pin around said means for pivoting said pin thereby moving said upper end of said pin from a position below said cam to a position forward of said cam in response to forward movement of said grip safety, said means for positioning said pin comprising:

A) a spring, located within said slot, having its direction of compression colineal with said slot, said spring encircling said pin, said spring having a lower edge located closest to said grip safety aperture;

B) means for positioning said spring within said slot; and

C) means, attached to said pin, for transferring the bias of said spring to said pin when said spring is compressed so that said pin is biased toward said grip member aperture thereby biasing said cross pin into contact with said upper surface of said grip member.

12. The tertiary safety of claim 11 wherein said cross pin is attached to said pin at a right angle.

13. The tertiary safety of claim 11 wherein said grip member includes a means for orienting said cross pin with respect to said grip member.

14. The tertiary safety of claim 13 wherein said means for orienting said cross pin comprises a ridge extending across said grip member, said ridge contacting said cross pin thereby preventing said cross pin from rotating about the elongated axis of said pin.

15. The tertiary safety of claim 11 wherein said means for positioning said spring comprises a loop attached to said grip safety across said slot, said loop providing a constriction in said slot narrower than said spring whereby said spring and said pin is constrained within said slot.

16. The tertiary safety of claim 11 wherein said grip member is a mainspring housing.

17. A self-engaging tertiary safety for a handgun having a hammer releasable by a sear, said handgun also having a grip, thumb safety and a grip safety, said thumb safety having a cam attached thereto, said cam immobilizing a sear when said thumb safety is placed in an active position thereby preventing the hammer of said handgun from falling, said grip safety having a slot extending along the forwardmost edge of said grip safety, said handgun also having a grip member being a mainspring housing located below said grip safety in said grip of said handgun, said tertiary safety comprising:

a) an elongated pin having an upper and a lower end, said pin extending from a grip member aperture, said grip member aperture extending downward into said grip member from the upper surface of said grip member, said pin extending upward from said grip member aperture through a grip safety aperture in the lowermost edge of said grip safety thereby connecting said lowermost edge with said slot, said pin extending through said slot to a point above said grip safety; and, b) means for moving said upper end of said pin from a position below said cam to a position forward of said cam in response to forward movement of said grip safety whereby said upper end of said pin prevents said cam from moving to a position to allow said sear to allow said hammer to fall, said can prevented from moving downward by physical contact between said upper end of said pin and said cam when said grip safety is in a position below said cam and whereby said upper end of said pin is moved forward of said cam in response to forward movement of said grip safety, thereby permitting said cam to move to a position to allow said sear to allow said hammer to fall, said cam moving to a position to allow said sear to allow said hammer to fall in response to downward movement of said thumb safety, said means for moving said upper end of said pin comprising:

i) means for pivoting said pin around the upper edge of said grip member aperture comprising a cross pin attached to said pin at a right angle, said cross pin spanning said grip member aperture; and, ii) means for positioning said pin within said slot so that movement of said grip safety contacts said pin and rotates said pin around said means for pivoting said pin thereby moving said upper end of said pin from a position below said cam to a position forward of said cam in response to forward movement of said grip safety, said means for positioning said pin comprising:

A) a spring, located within said slot, having its direction of compression colineal with said slot, said spring encircling said pin, said spring having a lower edge located closest to said grip safety aperture;

B) means for positioning said spring within said slot comprising a loop attached to said grip safety across said slot, said loop providing a constriction in said slot narrower than said spring whereby said spring is constrained within said slot;

C) means, attached to said pin, for transferring the bias of said spring to said pin when said spring is compressed so that said pin is biased toward said grip member aperture thereby biasing said cross pin into contact with said upper surface of said grip member;

said grip member including means for orienting said cross pin with respect to said grip member comprising a ridge extending across said grip member, said ridge contacting said cross pin thereby preventing said cross pin from rotating about the elongated axis of said pin.

* * * * *